United States Patent [19]

Newling

[11] 4,195,691

[45] Apr. 1, 1980

[54] COMPOSITE SUCKER ROD STRING AND METHOD OF USE THEREOF

[75] Inventor: Robert P. Newling, St. Charles, Ill.

[73] Assignee: Joslyn Mfg. and Supply Co., Chicago, Ill.

[21] Appl. No.: 956,739

[22] Filed: Nov. 1, 1978

[51] Int. Cl.[2] ..... E21B 17/00; E21B 43/00

[52] U.S. Cl. ..... 166/315; 166/68; 166/72

[58] Field of Search ..... 52/726, 727; 166/77, 166/68, 75 R, 72, 105, 176, 315, 243, 244 C; 57/149

[56] References Cited

U.S. PATENT DOCUMENTS

| | | | |
|---|---|---|---|
| 851,118 | 4/1907 | Chadwick | 52/727 X |
| 3,234,723 | 2/1966 | Brown | 166/242 X |
| 3,486,557 | 12/1969 | Harrison | 52/727 X |
| 4,024,913 | 5/1977 | Grable | 166/242 X |

OTHER PUBLICATIONS

Frick et al., "Petroleum Production Handbook", vol. 1, "Mathematics and Production Equipment", McGraw-Hill Book Co., Inc., N.Y., 1962, pp. 8-1 to 8-14.

*Primary Examiner*—Stephen J. Novosad
*Attorney, Agent, or Firm*—Mason, Kolehmainen, Rathburn & Wyss

[57] ABSTRACT

A composite sucker rod string for connecting a subsurface well pump to a surface pumping unit utilizes a plurality of relatively elastic sucker rods, such as, polyfilament reinforced, resin bonded sucker rods in conjunction with a plurality of relatively inelastic sucker rods, such as, steel sucker rods, with the lengths and other parameters of the relatively elastic and relatively inelastic portions of the sucker rod string being selected to provide optimum pumping performance within the constraints imposed by the characteristics of the well and pumping equipment.

32 Claims, 2 Drawing Figures

COMPOSITE SUCKER ROD STRING AND METHOD OF USE THEREOF

BACKGROUND OF THE INVENTION

1. Field of the Invention

The present invention relates generally to sucker rod strings, and more particularly to a composite sucker rod string that utilizes both fiberglass reinforced, resin bonded sucker rods and steel sucker rods for connecting a subsurface well pump to a surface mounted pumping unit.

2. Description of the Prior Art

It is well known to utilize a plurality of sucker rods to form a sucker rod string for connecting a subsurface well pump to a surface pumping unit in order to impart a reciprocating pumping motion to the subsurface well pump. The sucker rods forming the sucker rod string have generally been fabricated from steel. Such steel rods have produced adequate pumping action; however, problems have been encountered with steel sucker rods in wells having heavy pumping loads, for example, as encountered in wells having low fluid levels and in deep wells. In such a well, the weight of an all-steel sucker rod string combined with the weight of the fluid load imposes an undue load on the surface pumping unit. Moreover, the life of an all-steel sucker rod string is limited when such a string is used in a corrosive well, since the corrosive action of the well tends to corrode and ultimately weaken the sucker rod string to the breaking point.

Recently, polyfilament reinforced, resin bonded sucker rods utilizing, for example, fiberglass reinforcing fibers have been introduced. Such polyfilament fiberglass sucker rods are described in U.S. patent application Ser. No. 576,731, filed May 12, 1975, and in U.S. patent application Ser. No. 956,740, entitled "IMPROVED SUCKER ROD AND INTERCONNECTIONS THEREFOR", filed concurrently by the present inventor, and assigned to the same assignee. Both applications are incorporated herein by reference. Such fiberglass sucker rods have the advantage that they are substantially lighter than steel, and that they are noncorrosive. Thus, such fiberglass rods reduce the load on the surface pumping unit, and they do not corrode in corrosive wells. However, fiberglass sucker rods have two properties that were heretofore considered to be disadvantages. They cannot support great compressive loads, and their modulus of elasticity is less than that of steel rods. Thus, it has been customary practice to utilize heavy steel bars known as sinker bars at the bottom end of the string in order to preload the string and maintain the fiberglass sucker rods in tension during the entire pumping stroke. However, in such a system, the reduced modulus of elasticity of the fiberglass rods causes fiberglass rods to stretch more than steel rods during the pumping cycle, and such stretch has caused reduced pumping efficiency by reducing the pump stroke imparted to the subsurface well pump. The present invention makes use of the increased stretch of the fiberglass rods, previously considered to be a disadvantage, to actually increase the pump stroke over that which would be obtained with relatively inelastic steel rods.

SUMMARY OF THE INVENTION

Accordingly, it is an object of the present invention to provide an improved sucker rod string utilizing relatively elastic sucker rods that overcomes many of the disadvantages of the prior art sucker rod strings.

It is another object of the present invention to provide an improved sucker rod string that combines the advantages of relatively elastic and relatively inelastic sucker rods.

It is another object of the present invention to provide an improved sucker rod string that combines the advantages of steel and polyfilament sucker rods.

It is yet another object of the invention to provide an improved sucker rod string that utilizes the inherent elasticity of polyfilament sucker rods, such as, fiberglass reinforced, resin bonded sucker rods to increase pumping efficiency.

It is still another object of the present invention to provide an improved sucker rod string that provides greater pumping efficiency than the prior art sucker rod strings.

It is still another object of the present invention to provide an improved sucker rod string that provides greater pumping capacity while simultaneously reducing the load applied to the surface pumping unit.

In accordance with a preferred embodiment of the invention, a sucker rod string is fabricated from a plurality of polyfilament reinforced sucker rods and a plurality of steel rods. In the present embodiment, continuous filaments of fiberglass which make up on the order of 79-80% of the rod by weight are used in the polyfilament rods, but other materials, such as graphite may be used in the fabrication of the polyfilament rods. The relative lengths of the polyfilament and steel portions of the sucker rod string are determined by the various well parameters, such as pump diameter, pump stroke, surface unit stroke, number of strokes per minute in order to optimize pumping efficiency. Such optimization often results in a pump stroke at the subsurface well pump that is greater than the stroke of the surface unit, thus greatly increasing production.

BRIEF DESCRIPTION OF THE DRAWING

These and other objects and advantages of the present invention will be readily apparent upon consideration of the following detailed description and attached drawing, wherein.

DETAILED DESCRIPTION OF THE PREFERRED EMBODIMENT

Figure 1:
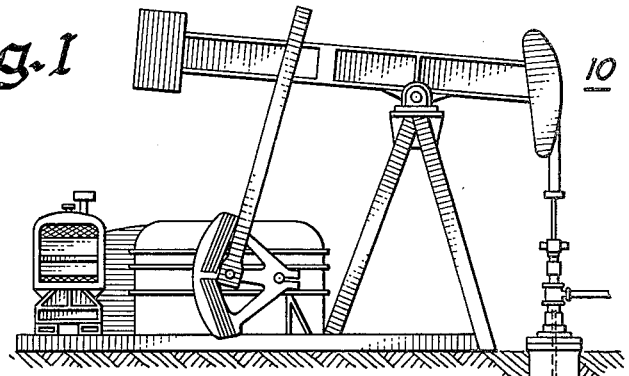
FIG. 1 is a plan view of a sucker rod string according to the invention connecting a pumping unit and a subsurface well pump.

Referring now to the drawing, with particular attention to FIG. 1, there is shown a surface pumping unit 10 that actuates a subsurface pump 12 by means of a sucker rod string 14 which comprises several relatively elastic polyfilament fiberglass reinforced, resin bonded sucker rods 16 connected end-to-end and a plurality of similarly connected relatively inelastic steel sucker rods 18. In a typical embodiment, the pump 12 may be several thousand feet below the surface and the sucker rod string may include several hundred rods 16 and 18. In a preferred embodiment, each of the polyfilament rods 16 is approximately 37.5 feet in length and has a diameter of approximately $\frac{7}{8}$ inch or, more precisely, 0.845 inch. The percentage of fiberglass content in such rods is on the order of 79–80% by weight, and the resin is polyester. The steel sucker rods 18 are typically 25 feet in length and have a similar diameter. However, the relatively elastic and relatively inelastic rods may be fabricated in various lengths and diameters, and fabricated from various materials. Also, more than two different types of rods may be used, particularly if a more complex weight and elasticity distribution is required.

When a sucker rod string of the type illustrated in FIG. 1 is utilized, the dynamics of the pumping action results in a periodic stretching of the string 14, particularly of the fiberglass portion. Such stretching was previously considered to be disadvantageous; however, it has been found that by properly adjusting the elasticity of the sucker rod string by adjusting the length of the relatively elastic fiberglass portion of the sucker rod string relative to the length of the steel portion, as well as the pumping speed, the length of the stroke at the subsurface pump 12 can be made to exceed the length of the stroke produced by the surface pumping unit 10. Such an increase in stroke provides a substantial increase in the amount of fluid that can be pumped in a given time interval compared to that which can be pumped by relatively inextensible steel sucker rod strings within the same time period. The dynamics are illustrated in Diagrams I-IX of FIG. 2.

Basically, the increased pump stroke $S_p$ occurs as a result of variations in the stretch of the sucker rod string during the pumping cycle, particularly of the fiberglass portion which is more elastic than the steel portion. Such variations in the stretch of the rod string occur as a result of changes in the pump load as a result of the weight of the fluid pumped, and as a result of the acceleration and deceleration of the sucker rod string, particularly of the steel portion, when its direction of travel is changed. For example, when the sucker rod string is stationary or travelling in a downward direction at a uniform rate, as illustrated in Diagram I (FIG. 2), and the string is not being subjected to any fluid load forces or accelerations other than gravity, the only force stretching the fiberglass string is its own weight and the weight of the steel string. Similarly, the only force stretching the steel string is its own weight. However, when the arm of the pumping unit 10 reaches the bottom of its pumping stroke and instantaneously stops prior to beginning its upward stroke, as illustrated in Diagram II (FIG. 2), the bottom of the rod string does not stop instantaneously, but rather, continues to move downward as a result of inertia (i.e., the property of matter by which it remains at rest or in uniform motion in the same straight line unless acted upon by some external force), particularly the inertia of the steel rods 18. The continued movement causes the fiberglass portion of the string to stretch by an amount OT, which results in overtravel at the bottom of the rod string. As the surface pumping unit 12 begins its upward stroke (Diagram III, FIG. 2), the fiberglass portion of the string is further stretched as the fiberglass string accelerates both the steel string and the fluid load of the pump in an upward direction. The rod string must also accelerate the fluid in the pump in an upward direction, and the contribution to the overall stretch produced by the fluid load is represented by the term RS (Diagram IV). Thus, the upper end of the string rises faster than the lower end. The steel portion of the sucker rod string is also stretched in a similar manner; however, since the major portion of the stretch occurs in the fiberglass portion of the string, a discussion of the effects of the steel portion will be deferred until a subsequent portion of the specification for reasons of clarity.

In a similar fashion, as the pumping unit approaches the top of its stroke, the inertia in the string, as well as the energy stored in the string in the form of rod stretch, cause the lower end of the string to continue to move in an upward direction, thereby reducing the amount of stretch in the fiberglass portion of the rod (Diagrams IV and V, FIG. 2), until the amount of stretch is reduced to its static value or less (Diagram VI) whereupon the cycle is repeated (Diagrams VII-IX).

In order to obtain an increase (rather than a decrease) in the pump stroke at the bottom of the well, the rod string must be tailored to operate within the constraints of a particular well, and its parameters must be adjusted to conform to various well parameters, such as depth, fluid load, and extraneous factors such as friction. In particular, the weight of the fluid lifted during each pump stroke, as well as the weight of the rod string and the elasticity of the rod string, must be considered. This is because, under dynamic conditions, the weight of the rod string periodically stretches the rod string and thus stores potential energy in the rod string during a portion of each pumping cycle (Diagram III). The potential energy thus stored can then be retrieved during another portion of the pumping cycle to aid in the lifting of the fluid (Diagrams IV and V). If the force resulting from the stored potential energy when the rod subsequently contracts is greater than the force required to lift the fluid load during the up stroke of the pump, a net increase in pump stroke results. Conversely, if insufficient potential energy is stored as a result of too heavy a fluid load, or too elastic or too light a rod string, the net pump stroke is actually decreased.

The pump stroke $S_p$ is related to the surface stroke, rod weight and fluid load according to the following relation:

$$S_p = S + OT - RS \tag{1}$$

wherein

S = the surface stroke

OT = overtravel due to rod weight and accelerations

RS = rod stretch due to the fluid load

Figure 2:
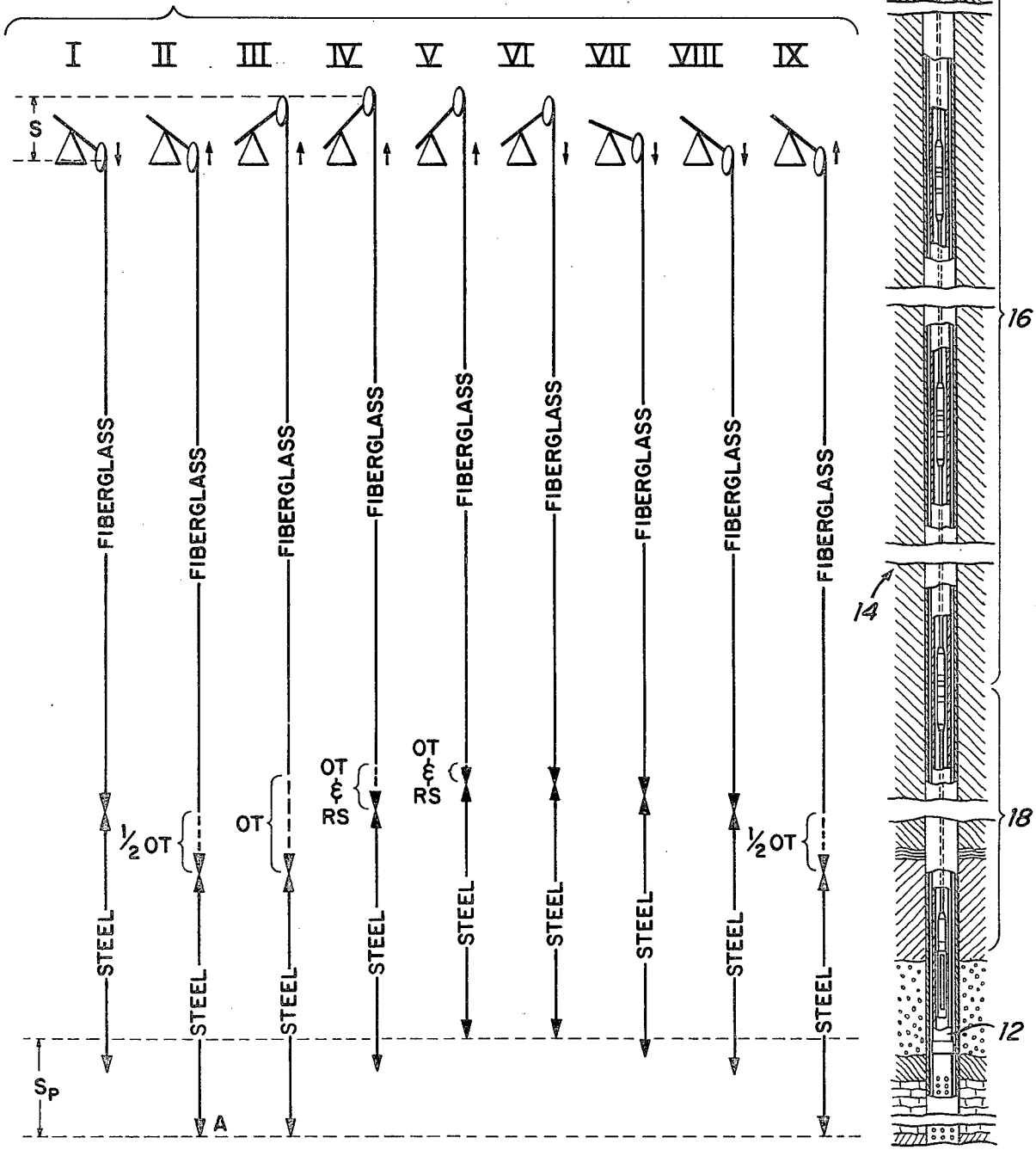
FIG. 2 is a graphical representation showing the effects of stretch in the sucker rod string during various portions of the pumping cycle.

From the above relationship and from FIG. 2, it is evident that the weight of the rod string stores up energy in the form of overtravel at the end of the down stroke which increases the pump stroke. The fluid load produces rod stretch during the up stroke which reduces the pump stroke. Thus, the elasticity and weight of the rod string, as determined by the relative proportions of fiberglass and steel rods, as well as by the elasticity of the rods, particularly of the fiberglass rods, must be tailored to maximize the difference between the overtravel term OT and the rod stretch term RS in the above equation (1).

In order to derive the parameters of an optimum rod string, one begins with the basic stress-strain equation:

$$\epsilon = \sigma / E \tag{2}$$

where $\epsilon$ = strain $\sigma$ = stress

E = the modulus of elasticity

In a steel and fiberglass rod string, the average stress on the fiberglass string, $\sigma_1$, becomes (ignoring the effect of buoyancy on the weight of the rod):

$$\sigma f = \frac{(\text{weight of steel}) + \frac{1}{2}(\text{weight of fiberglass})}{\text{area of fiberglass}} \quad (3)$$

Similarly, the average stress on the steel portion of the rod, $\sigma_s$, becomes:

$$\sigma_s = \frac{\frac{1}{2}(\text{weight of steel})}{\text{area of steel}} \quad (4)$$

Thus, the total strain on the rod string can be calculated by summing the individual strains of the steel and fiberglass portions of the rod string so that the total strain becomes:

$$\epsilon = 12\left(\frac{L_f\sigma_f}{E_f} + \frac{L_s\sigma_s}{E_s}\right) \quad (5)$$

where $E_f$ and $E_s$ represent the modulus of elasticity of fiberglass and steel, respectively; $L_f$ represents the total length of the top (fiberglass) rods in feet; $L_s$ represents the total length of the bottom (steel) rods in feet; $E_f$ represents the modulus of elasticity of the top (fiberglass) rods in pounds per square inch; $E_s$ represents the modulus of elasticity of the bottom (steel) rods in pounds per square inch; and 12 converts feet of rod into inches.

The above equation represents the strain on a stationary rod string resulting from gravity without taking into account strains produced by acceleration; however, the effects of acceleration can readily be factored in by modifying the above equation (5) as follows:

$$\epsilon = 12a\left(\frac{L_f\sigma_f}{E_f} + \frac{L_s\sigma_s}{E_s}\right) \quad (6)$$

where a represents the acceleration imparted to the rod string. Since the amount of elongation of the rod string caused by gravity is constant, only the effect of the variable acceleration contributes to overtravel. Thus, equation (6) which includes the acceleration factor, a, fully defines the overtravel on this downstroke. At the beginning of the upstroke, the rod gains further overtravel as a result of the acceleration of the pumping unit upward (FIG. 2, Diagram III). Thus, at the beginning of the upstroke, the total overtravel of the rod string is equal to the overtravel caused by the acceleration imparted to the rod string by the pumping unit and the overtravel already present at the end of the down stroke and defined by equation (6), this giving a total overtravel of:

$$OT = 24a\left(\frac{L_f\sigma_f}{E_f} + \frac{L_s\sigma_s}{E_s}\right) \quad (7)$$

$$OT = 24a\left[\frac{L_f}{A_fE_f}\left(\frac{W_f}{2} + W_s\right) + \frac{L_s}{A_sE_s}\left(\frac{W_s}{2}\right)\right] \quad (8)$$

where $A_f$ represents the area of the top (fiberglass) rods in square inches; $A_s$ represents the area of the bottom (steel) rods in square inches; $W_f$ represents the weight of the top (fiberglass) rods in air in pounds; and $W_s$ represents the weight of the bottom (steel) rods in air in pounds.

The effects of acceleration and gravity on the fluid must also be determined in determining rod stretch. Consequently, the fluid load which is present only on the upstroke, must be calculated. The fluid load is equal to:

$$F_{66} = (1+a)F \quad (9)$$

where $F_{66}$ represents accelerated fluid load and F represents fluid load at rest (gravity only). Rod stretch due to this accelerated fluid load is equal to:

$$RS = 12\left(\frac{L_f\sigma_f}{E_f} + \frac{L_s\sigma_s}{E_s}\right) \quad (10)$$

where, in equation (10)

$$\sigma_f = \frac{F_\Delta}{\text{area of fiberglass}} \quad (11)$$

$$\sigma_s = \frac{F_\Delta}{\text{area of steel}} \quad (12)$$

Thus, $$RS = 12(1+a)F\left[\frac{L_f}{A_fE_f} + \frac{L_s}{A_sE_s}\right] \quad (13)$$

Substituting equations (8) and (13) into equation (1):

$$S_p = S + 24a\left[\frac{L_f}{A_fE_f}\left(\frac{W_f}{2} + W_s\right) + \frac{L_s}{A_sE_s}\left(\frac{W_s}{2}\right)\right] - 12(1+a)F\left[\frac{L_f}{A_fE_f} + \frac{L_s}{A_sE_s}\right] \quad (14)$$

Rearranging terms and simplifying, the equation for determining the pump stroke becomes:

$$S_p = S + 12\left[\frac{L_f}{A_fE_f}(a(W_f + 2W_s - F) - F) + \frac{L_s}{A_sE_s}(a(W_2 - F) - F)\right] \quad (15)$$

where S represents the surface stroke in inches; $S_p$ represents the net pump stroke in inches; a represents the acceleration factor which equals Mills' acceleration factor or $SN^2/K$, where K equals 70,500 for most pumping units; N represents the number of strokes per minute provided by the surface pumping unit; and F represents the fluid load, which equals $0.34D^2HG$ in pounds where D equals the pump diameter in inches, H equals the fluid level in feet and G equals the specific gravity of the fluid.

The above equation has been derived for a composite string utilizing two different types of rods, one fiberglass and one steel; however, the equation may be readily generalized for rod strings containing various types of rods having more than two or more diameters and moduli as follows:

$$S_p = S + 12\left[\frac{L_i}{A_iE_i}(a(W_i + 2W_{i+1} + 2W_{i+2} + \ldots \quad (16)$$

-continued $$+ 2W_{i+j} - F) - F)$$

$$+ \frac{L_{i+1}}{A_{i+1}E_{i+1}} (a(W_{i+1} + 2W_{i+2} + \ldots$$

$$+ 2W_{i+j} - F) - F)$$

$$+ \ldots + \frac{L_{i+j}}{A_{i+j}E_{i+j}} (a(W_{i+j} - F) - F) \Big]$$

wherein the variables are as defined above, with the subscript i indicating variables pertaining to the top rods in the string, the subscript i+1 indicating the rods positioned second from the top of the string, and so on, with the subscript i+j indicating the bottom rods of the string.

The above equations have many degrees of freedom and thus permit great flexibility in the design of wells and sucker rod strings. For a new well, it is possible to select a pump diameter and a surface stroke, as well as the make up of the sucker rod string, to achieve optimum pumping capability. However, even for existing wells where the pump diameter and the surface stroke are generally fixed, the make up of the sucker rod string can be optimized for the particular pump and surface stroke used, and it has been found that in practice, substantial improvements in production can be made in existing wells while simultaneously reducing the load on the surface pumping unit and the power required to drive the pumping unit. The improvement in production can be dramatic, and it is often possible to more than double the production of a well by installing a composite string instead of an all-steel string. Moreover, the improvement is achieved without increasing the size of the pumping unit and even with the increased production, the load on the pumping unit is substantially reduced thus making it possible to use a pumping unit that would be too small for use with a conventional steel rod string. Thus, the use of a composite sucker rod string represents a very economical way of substantially increasing production.

For example, in a particular 8,000 foot well, by replacing an all-steel sucker rod string with a composite string having the top 5,600 feet fabricated from 0.845 inch diameter fiberglass sucker rods, and the bottom 2,400 feet fabricated from $\frac{7}{8}$ inch steel sucker rods, and by utilizing a $1\frac{1}{2}$ inch diameter pump plunger with a surface stroke of 120 inches at 14 strokes per minute, the production of the well was increased from 200 barrels of fluid per day to 400 barrels of fluid per day utilizing the same surface pumping unit. Moreover, in spite of the increased production, and an increase in pumping speed from a previous 10 strokes per minute, the peak load of the pumping unit was reduced by 27%. Also, the surface stroke of 120 inches resulted in a pump stroke of approximately 150 inches when the composite string was installed. Thus, the composite string provided a 25% increase in pump stroke over the surface stroke. In a typical composite string built in accordance with the principles of the invention utilizing 0.845 inch diameter fiberglass rods, having a modulus of elasticity of approximately $7.2 \times 10^6$ lbs/in$^2$, which is approximately one-fourth that of steel, the percentage of fiberglass rods is on the order of approximately 50% by length; however, this percentage can vary considerably depending on the diameters of the sucker rods used. When steel sucker rods having a range of diameters, for example, $\frac{3}{4}$ inch to 1 inch are used, the percentage of fiberglass rods by length used in a composite string can vary from 20% to 80%. This compares to a typical fiberglass length of 88% to 92% when $1\frac{1}{2}$ inch steel sinker bars are used.

The equations for determining the make up of the composite sucker rod string described in the foregoing are idealized equations, and do not take into account the effects of friction which can result from crooked wells and other sources. Despite the lack of a friction term, the equations have been found to be better than 90% accurate in predicting actual performance. However, the equations can be made even more accurate by adding a constant to the equation defining the pump stroke. Such a constant can be determined empirically by comparing the actual production of a producing well with the predicted production and setting the difference equal to the constant. The effects of friction can also be taken into account by adjusting the weight of the string or the weight of the fluid in the pump stroke equation.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A sucker rod string for mechanically connecting a surface pumping unit to a subsurface pump located within a well, said sucker rod string comprising:

a plurality of nonmetallic sucker rods serially interconnected end-to-end to form a first section of the sucker rod string, said first section having a first predetermined length and first and second ends, said first end of said first section being mechanically coupled to said surface pumping unit;

a plurality of metallic sucker rods serially interconnected end-to-end to form a second section of the sucker rod string disposed below said first section, said second section having a second predetermined length and first and second ends, said first end of said second section being mechanically coupled to said second end of said first section and said second end of said second section being mechanically coupled to said pump, the lengths of the first and second sections being selected to maximize the relation:

$$\frac{L_f}{A_f E_f} (a(W_f + 2W_s - F) - F) + \frac{L_s}{A_s E_s} (a(W_s - F) - F)$$

where $L_f$ and $L_s$ are the lengths of the nonmetallic and metallic rod string sections in feet, respectively; $A_f$ and $A_s$ are the cross-sectional areas of the nonmetallic and metallic rod sections in square inches, respectively; $E_f$ and $E_s$ are the moduli of elasticity in pounds per square inches of the nonmetallic and metallic rod string sections, respectively; $W_f$ and $W_s$ are the weights in pounds of the nonmetallic and metallic rod sections, respectively; F is the weight in pounds of the fluid lifted during each pump stroke; and a equals an acceleration factor defining the acceleration applied to the rod string by the pumping unit.

2. A sucker rod string as recited in claim 1 wherein a is defined by the relation $SN^2/70{,}500$, where S equals the length of the stroke of the surface unit in inches; and N is equal to the number of strokes per minute, wherein said relation may be renormalized to other units by utilizing appropriate conversion factors.

3. A sucker rod string as recited in claim 1 wherein said nonmetallic sucker rods are polyfilament rods.

4. A sucker rod string as recited in claim 3 wherein said polyfilament rods are fabricated from resin bonded fiberglass filaments.

5. A sucker rod string as recited in claim 4 wherein said fiberglass filaments are continuous filaments running the entire length of the rod.

6. A sucker rod string as recited in claim 3 wherein said metallic sucker rods are fabricated from steel.

7. A sucker rod string as recited in claim 6 wherein said fiberglass sucker rods comprise approximately 20% to 80% of the total length of the sucker rod string.

8. A method of mechanically connecting a subsurface well pump to a surface mounted pumping unit by means of a sucker rod string, comprising the steps of:

serially interconnecting a plurality of metallic sucker rods to form a lower section of the sucker rod string;

serially interconnecting a plurality of nonmetallic sucker rods to form an upper section of the sucker rod string;

serially coupling said upper and lower sections of the sucker rod string;

mechanically coupling said lower section to said well pump;

mechanically coupling said upper section to said pumping unit; and adjusting the lengths of said upper and lower sections forming the string in accordance with weight and elasticity of each section and the weight of the fluid lifted during each pump stroke to optimize pumping efficiency.

9. The method recited in claim 8 wherein the step of adjusting the lengths of said upper and lower sections includes the step of adjusting the length of said upper section over a range of approximately 20% to 80% of the total length of the sucker rod string.

10. A method of connecting a subsurface well pump to a surface mounted pumping unit by means of a sucker rod string, comprising the steps of:

serially interconnecting a plurality of metallic sucker rods to form a metallic section of the sucker rod string;

serially interconnecting a plurality of nonmetallic section of the sucker rod string;

serially interconnecting said metallic and nonmetallic sections of the sucker rod string so that the metallic section is disposed below said nonmetallic section;

mechanically coupling said metallic section to said well pump;

mechanically coupling said nonmetallic section to said pumping unit; and determining the relative length of said nonmetallic and said metallic sections by determining the weight of the fluid lifted during each stroke of the subsurface well pump and adjusting the relative length of the metallic and nonmetallic sections of said sucker rod string in order to maximize the relation:

$$\frac{L_f}{A_f E_f}(a(W_f + 2W_s - F) - F) + \frac{L_s}{A_s E_s}(a(W_s - F) - F)$$

where $L_f$ and $L_s$ are the length of the nonmetallic and metallic rod string sections in feet, respectively; $A_f$ and $A_s$ are the cross-sectional areas of the nonmetallic and metallic rod sections in inches, respectively; $E_f$ and $E_s$ are the moduli of elasticity in pounds per square inches of the nonmetallic and metallic rod string sections, respectively; $W_f$ and $W_s$ are the weights in pounds of the nonmetallic and metallic rod sections, respectively; F is the weight in pounds of the fluid lifted during each pump stroke; and a equals an acceleration factor defining the acceleration imposed on the rod string by the pumping unit.

11. The method recited in claim 10 wherein a is defined by the relation $SN^2/70{,}500$, where S equals the length of the stroke of the surface unit in inches; and N is equal to the number of strokes per minute, wherein said relation may be renormalized to other units by utilizing appropriate conversion factors.

12. The method recited in claim 10 wherein the step of determining the lengths of said metallic and nonmetallic sections includes the steps of setting the length of said upper section to equal approximately 20% to 80% of the total lengths of the string.

13. The method recited in claim 12 further including the step of setting the coefficient of elasticity of the nonmetallic sucker rods to approximately $7.2 \times 10^6$ lbs/in$^2$.

14. The method recited in claim 12 further including the step of setting the coefficient of elasticity of said nonmetallic sucker rods to approximately one-fourth that of said metallic sucker rods.

15. The method recited in claim 10 wherein said nonmetallic sucker rods are fabricated from resin bonded fiberglass and said metallic sucker rods are fabricated from steel further including the steps of setting the diameter of said fiberglass sucker rods to approximately $\frac{7}{8}$ inch and the diameter of said steel sucker rods from $\frac{3}{4}$ inch to 1 inch.

16. A composite sucker rod string for mechanically connecting a surface pumping unit to a subsurface pump located within a well, said sucker rod string comprising:

a plurality of nonmetallic sucker rods serially interconnected end-to-end to form a nonmetallic section of the sucker rod string, said upper section having a first predetermined length, diameter and elasticity, and first and second ends, said first end of said upper section being mechanically coupled to said surface pumping unit; and a plurality of metallic sucker rods serially interconnected end-to-end to form a metallic section of the sucker rod string disposed below said nonmetallic section, said metallic section having a second predetermined length, diameter and elasticity, and first and second ends, said first end of said metallic section being mechanically coupled to said second end of said nonmetallic section and said second end of said metallic section being mechanically coupled to said pump, the lengths and diameters of the metallic and nonmetallic sections being selected to maximize the potential energy stored in the sucker rod string as a result of stretch induced in the sucker rod string by the weight of said string relative to the force required to actuate said subsurface pump.

17. A composite sucker rod string as recited in claim 16 wherein said nonmetallic sucker rods are polyfilament rods.

18. A composite sucker rod string as recited in claim 17 wherein said polyfilament rods are fabricated from resin bonded filaments of fiberglass.

19. A composite sucker rod string as recited in claim 17 wherein said metallic sucker rods are fabricated from steel.

20. A composite sucker rod string as recited in claim 17 wherein said polyfilament sucker rods comprise approximately 20% to 80% of the total length of the composite sucker rod string.

21. A composite sucker rod string as recited in claim 20 wherein said polyfilament sucker rods have a diameter of approximately $\frac{7}{8}$ inch.

22. A composite sucker rod string as recited in claim 21 wherein said steel sucker rods have a diameter ranging from approximately $\frac{3}{4}$ inch to approximately 1 inch.

23. A composite sucker rod string as recited in claim 22 wherein said polyfilament sucker rods have a modulus of elasticity of approximately $7.2\times10^6$lbs/in$^2$.

24. A composite sucker rod string as recited in claim 22 wherein the coefficient of elasticity of said polyfilament sucker rods is approximately one-fourth the coefficient of elasticity of said steel sucker rods.

25. A composite sucker rod string for mechanically connecting a surface pumping unit to a subsurface pump located within a well, said sucker rod string comprising:

a plurality of sets of end-to-end connected sucker rods having various physical properties, each of the various sucker rod sets having various weights, diameters and moduli of elasticity wherein the proportion of the total length of the string formed by each set of rods is selected to maximize the following relation:

$$\left[\frac{L_i}{A_iE_i}(a(W_i+2W_{i+1}+2W_{i+2}+\ldots+2W_{i+j}-F)-F)+\frac{L_{i+1}}{A_{i+1}E_{i+1}}(a(W_{i+1}+2W_{i+2}+\ldots+2W_{i+j}-F)-F)+\ldots+\frac{L_{i+j}}{A_{i+j}E_{i+j}}(a(W_{i+j}-F)-F)\right]$$

wherein:

L=the total length of the proportion of the string formed by one of said sets of sucker rods in feet;

A=the cross-sectional area of one of said sets of sucker rods in square inches;

E=the modulus of elasticity of one of said sets of sucker rods in pounds per square inch;

a=an acceleration factor defining the acceleration, other than gravity applied to the rod string;

W=the total weight of all of the sucker rods of one of said sets in air in pounds;

F=the fluid load, which equals $0.34D^2HG$ in pounds where D equals the pump diameter in inches, H equals the fluid level in feet and G equals the specific gravity of the fluid;

wherein the subscript i indicates variables pertaining to the top set of rods in the string, the subscript i+1 indicates the set of rods positioned second from the top of the string, and so on, and the subscript i+j indicates the bottom set of rods of the string, and wherein the relation may be renormalized to other units by utilizing appropriate conversion factors.

26. A composite sucker rod string as recited in claim 25 wherein the modulus of elasticity of one of said sets of sucker rods is approximately four times that of another one of said sets.

27. A composite sucker rod string as recited in claim 26 wherein the set of sucker rods having the lower modulus of elasticity is positioned above the set of sucker rods having the greater modulus of elasticity.

28. A composite sucker rod string as recited in claim 27 wherein said set of sucker rods having the lower modulus of elasticity is fabricated from continuous resin bonded filaments and the set of sucker rods having the greater modulus of elasticity is fabricated from steel.

29. A composite sucker rod string as recited in claim 28 wherein said filaments are fiberglass and comprise approximately 79–80% of the rod by weight.

30. A composite sucker rod string as recited in claim 29 wherein said fiberglass sucker rods have a diameter on the order of approximately $\frac{7}{8}$ inch, and wherein said steel sucker rods have a diameter in the range of approximately $\frac{3}{4}$ inch to approximately 1 inch.

31. A composite sucker rod string as recited in claim 30 wherein said fiberglass sucker rods comprise approximately 20% to 80% of the total length of the sucker rod string.

32. In a system for pumping fluid from a well of the type having a subsurface well pump that is actuated by a surface pumping unit mechanically coupled to the subsurface well pump by means of a sucker rod string which transfers a mechanical reciprocating motion from the surface pumping unit to the subsurface well pump in order to actuate the well pump, the surface pumping unit having a predetermined surface stroke and the subsurface pump having a pump stroke different than said surface stroke as a result of stretch in the sucker rod string, the method of increasing the pump stroke relative to the surface stroke comprising the steps of:

fabricating the sucker rod string from a plurality of individual sucker rods having different physical characteristics interconnected end-to-end, a first plurality of the sucker rods forming said sucker rod string having relatively lighter weight and relatively lesser elasticity than a second plurality of sucker rods forming said string, said step of fabricating said sucker rod string comprising the steps of positioning said first plurality of sucker rods within the string so that said first plurality of sucker rods is positioned above said second plurality of sucker rods, determining the weight of fluid lifted by the pump during each stroke, and adjusting the relative numbers of said first and second sucker rods in accordance with the weight of the fluid lifted and the weights and elasticities of the sucker rods to maximize said pump stroke.

* * * * *

UNITED STATES PATENT AND TRADEMARK OFFICE

CERTIFICATE OF CORRECTION

PATENT NO. : 4,195,691

DATED : April 1, 1980

INVENTOR(S) : Robert P. Newling

It is certified that error appears in the above–identified patent and that said Letters Patent are hereby corrected as shown below:

Claim 10, column 9, line 49, after "nonmetallic" insert --sucker rods to form a nonmetallic--

Signed and Sealed this

*Eighth* Day of *July 1980*

[SEAL]

*Attest:*

SIDNEY A. DIAMOND

*Attesting Officer*

*Commissioner of Patents and Trademarks*